US009147932B2

(12) United States Patent
Yarga et al.

(10) Patent No.: US 9,147,932 B2
(45) Date of Patent: Sep. 29, 2015

(54) TUNABLE MULTIBAND ANTENNA WITH DIELECTRIC CARRIER

(71) Applicant: Apple Inc., Cupertino, CA (US)

(72) Inventors: Salih Yarga, Sunnyvale, CA (US); Qingxiang Li, Mountain View, CA (US); Matthew A. Mow, Los Altos, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 304 days.

(21) Appl. No.: 13/647,106

(22) Filed: Oct. 8, 2012

(65) Prior Publication Data

US 2014/0100004 A1 Apr. 10, 2014

(51) Int. Cl.

| | |
|---|---|
| ***H04M 1/00*** | (2006.01) |
| ***H01Q 1/38*** | (2006.01) |
| ***H01Q 9/06*** | (2006.01) |
| ***H01Q 1/24*** | (2006.01) |

(52) U.S. Cl.

CPC ..... *H01Q 1/38* (2013.01); *H01Q 1/243* (2013.01); *H01Q 9/06* (2013.01)

(58) Field of Classification Search

CPC ..... H01Q 1/243; H01Q 1/244; H01Q 1/245; H01Q 1/42; H01Q 1/422; H01Q 1/38; H01Q 9/06; H04W 88/02

USPC ..... 455/575.8, 575.1, 121, 562.1, 575.7, 455/575.5, 575.6, 90.3, 104, 106, 107, 111; 343/700, 745, 736, 702, 720, 866, 848, 343/741, 850, 893; 174/126.1

See application file for complete search history.

(56) References Cited

U.S. PATENT DOCUMENTS

| | | | | |
|---|---|---|---|---|
| 6,246,298 | B1 * | 6/2001 | Ishikawa et al. | 333/101 |
| 7,710,331 | B2 | 5/2010 | Schillmeier et al. | |
| 8,138,987 | B2 | 3/2012 | Kapuliansky et al. | |
| 8,164,538 | B2 | 4/2012 | Montgomery et al. | |
| 2005/0264452 | A1 * | 12/2005 | Fujishima et al. | 343/700 MS |
| 2007/0080864 | A1 * | 4/2007 | Channabasappa | 343/700 MS |
| 2008/0278405 | A1 * | 11/2008 | Montgomery et al. | 343/893 |
| 2009/0231206 | A1 * | 9/2009 | Shamblin et al. | 343/700 MS |
| 2010/0013732 | A1 * | 1/2010 | Kapuliansky et al. | 343/866 |
| 2010/0109955 | A1 * | 5/2010 | Anguera et al. | 343/702 |

(Continued)

OTHER PUBLICATIONS

Yarga et al., U.S. Appl. No. 13/468,289, filed May 10, 2012.

(Continued)

*Primary Examiner* — Tan Trinh

(74) *Attorney, Agent, or Firm* — Treyz Law Group; G. Victor Treyz; Michael H. Lyons

(57) ABSTRACT

Antenna structures for an antenna may be formed from a dielectric carrier with metal structures. The metal structures may be patterned to cover all sides of the dielectric carrier. The dielectric carrier may have a shape with six sides or other shape that creates a three-dimensional layout for the antenna structures. The antenna structures may have a tunable circuit that allows the antenna to be tuned. The tunable circuit may have first and second terminals coupled to one of the sides of the carrier. The metal structures may be configured to form an inverted-F antenna resonating element. Portions of the metal structures may form a first arm for an inverted-F antenna and portions of the metal structures may form a second arm for the inverted-F antenna. The antenna may operate in multiple communications bands. The tunable circuit may tune one band without significantly tuning other bands.

20 Claims, 13 Drawing Sheets

(56) References Cited

U.S. PATENT DOCUMENTS

| | | | | |
|---|---|---|---|---|
| 2010/0149050 | A1* | 6/2010 | stervall et al. | 343/702 |
| 2010/0245201 | A1* | 9/2010 | Hossain et al. | 343/848 |
| 2011/0043408 | A1* | 2/2011 | Shi et al. | 343/700 MS |
| 2011/0260924 | A1 | 10/2011 | Roy | |
| 2011/0291895 | A1* | 12/2011 | Zaila et al. | 343/702 |
| 2012/0169550 | A1* | 7/2012 | Schlub et al. | 343/702 |
| 2012/0223865 | A1* | 9/2012 | Li et al. | 343/702 |
| 2013/0154886 | A1* | 6/2013 | Isohatala | 343/702 |
| 2014/0266945 | A1* | 9/2014 | Dou | 343/770 |
| 2014/0313087 | A1* | 10/2014 | Jiang et al. | 343/745 |

OTHER PUBLICATIONS

Schlub et al., U.S. Appl. No. 13/420,278, filed Mar. 14, 2012.

* cited by examiner

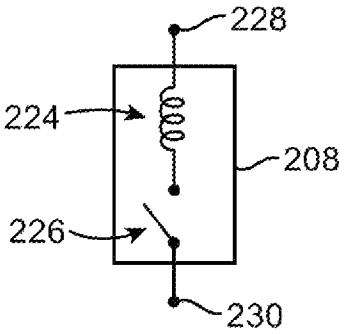
FIG. 4
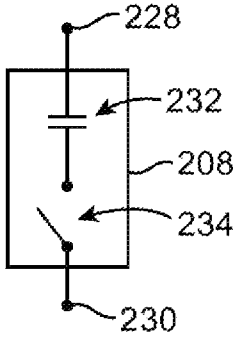
FIG. 5
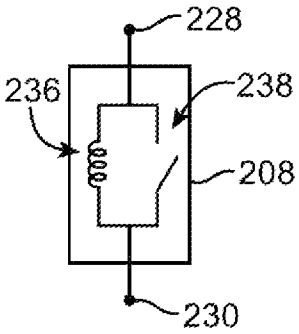
FIG. 6
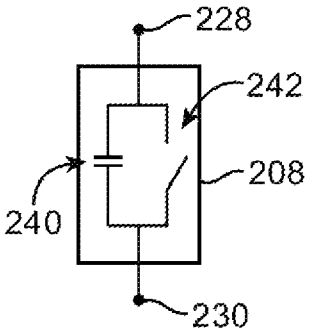
FIG. 7
FIG. 8
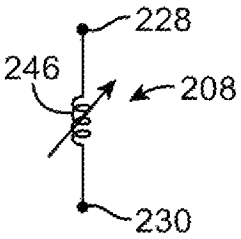
FIG. 9
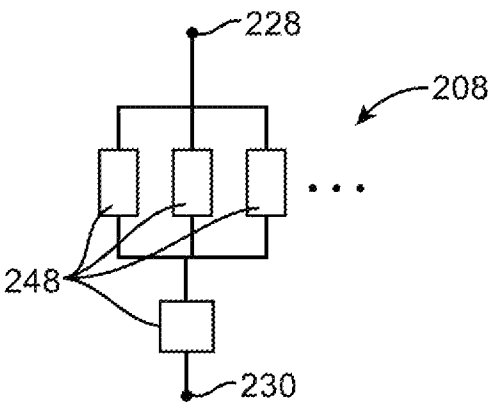
FIG. 10

TUNABLE MULTIBAND ANTENNA WITH DIELECTRIC CARRIER

BACKGROUND

This relates generally to electronic devices, and, more particularly, to antennas in electronic devices.

Electronic devices such as portable computers and handheld electronic devices are becoming increasingly popular. Devices such as these are often provided with wireless communications capabilities. For example, electronic devices may have wireless communications circuitry to communicate using cellular telephone bands and to support communications with satellite navigation systems and local wireless area networks.

It can be difficult to incorporate antennas and other electrical components successfully into an electronic device. Some electronic devices are manufactured with small form factors, so space for components is limited. In many electronic devices, the presence of conductive structures can influence the performance of electronic components, further restricting potential mounting arrangements for components such as antennas.

It would therefore be desirable to be able to provide improved electronic device antennas.

SUMMARY

An electronic device may have an antenna. Antenna structures for the antenna may be formed from a dielectric carrier such as a hollow plastic carrier covered with metal structures. The metal structures may be patterned to cover the plastic carrier.

The plastic carrier may have a shape such as a box shape with sides that create a three-dimensional layout for the antenna structures. The carrier may be provided with cavities.

The antenna structures may be provided with a tunable circuit to allow the antenna to be tuned. The tunable circuit may include components such as capacitors or inductors and may be tuned by controlling the operation of switches or other adjustable circuitry. The tunable circuit may have first and second terminals coupled to one of the sides of the plastic carrier.

The metal structures may be configured to form an antenna resonating element for an inverted-F antenna. Portions of the metal structures may form a first arm for the inverted-F antenna and portions of the metal structures may form a second arm for the inverted-F antenna. The antenna may operate in multiple communications bands. The tunable circuit may tune one band without significantly tuning other bands.

Further features of the invention, its nature and various advantages will be more apparent from the accompanying drawings and the following detailed description of the preferred embodiments.

BRIEF DESCRIPTION OF THE DRAWINGS

FIG. 4 is a circuit diagram of an illustrative tunable component based on a series-connected inductor and switch in accordance with an embodiment of the present invention.

FIG. 5 is a circuit diagram of an illustrative tunable component based on a series-connected capacitor and switch in accordance with an embodiment of the present invention.

FIG. 6 is a circuit diagram of an illustrative tunable component based on a parallel inductor and bypass switch in accordance with an embodiment of the present invention.

FIG. 7 is a circuit diagram of an illustrative tunable component based on a parallel capacitor and bypass switch in accordance with an embodiment of the present invention.

FIG. 8 is a circuit diagram of an illustrative tunable component based on a variable capacitor in accordance with an embodiment of the present invention.

FIG. 9 is a circuit diagram of an illustrative tunable component based on a variable inductor in accordance with an embodiment of the present invention.

FIG. 10 is a circuit diagram of an illustrative tunable component based on multiple components such as fixed and tunable components coupled in series and in parallel in accordance with an embodiment of the present invention.

DETAILED DESCRIPTION

Figure 1:
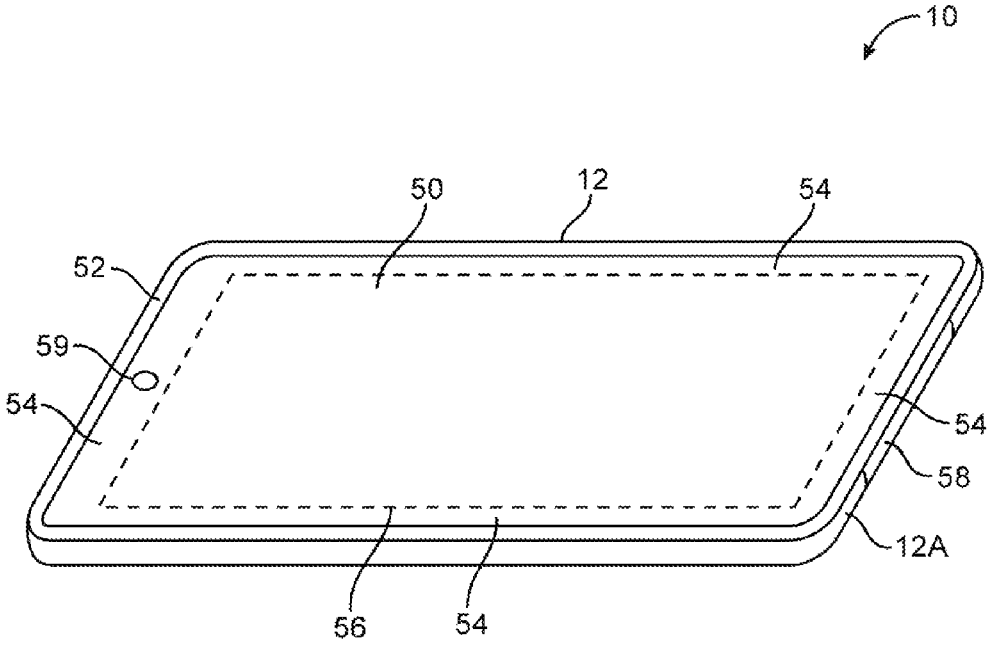
FIG. 1 is a front perspective view of an illustrative electronic device of the type that may be provided with antenna structures in accordance with an embodiment of the present invention.

Electronic devices may be provided with antennas, and other electronic components. An illustrative electronic device in which electronic components such as antenna structures may be used is shown in FIG. 1. As shown in FIG. 1, device 10 may have a display such as display 50. Display 50 may be mounted on a front (top) surface of device 10 or may be mounted elsewhere in device 10. Device 10 may have a housing such as housing 12. Housing 12 may have curved, angled, or vertical sidewall portions that form the edges of device 10 and a relatively planar portion that forms the rear surface of device 10 (as an example). Housing 12 may also have other shapes, if desired.

Housing 12 may be formed from conductive materials such as metal (e.g., aluminum, stainless steel, etc.), carbon-fiber composite material or other fiber-based composites, glass, ceramic, plastic, or other materials. A radio-frequency-transparent window such as window 58 may be formed in housing 12 (e.g., in a configuration in which the rest of housing 12 is formed from conductive structures). Window 58 may be formed from plastic, glass, ceramic, or other dielectric material. Antenna structures, and, if desired, proximity sensor structures for use in determining whether external objects are present in the vicinity of the antenna structures may be formed in the vicinity of window 58 or may be covered with dielectric portions of housing 12.

Device 10 may have user input-output devices such as button 59. Display 50 may be a touch screen display that is used in gathering user touch input. The surface of display 50 may be covered using a display cover layer such as a planar cover glass member or a clear layer of plastic. The central portion of display 50 (shown as region 56 in FIG. 1) may be an active region that displays images and that is sensitive to touch input. Peripheral portions of display 50 such as region 54 may form an inactive region that is free from touch sensor electrodes and that does not display images.

An opaque masking layer such as opaque ink or plastic may be placed on the underside of display 50 in peripheral region 54 (e.g., on the underside of the cover glass). This layer may be transparent to radio-frequency signals. The conductive touch sensor electrodes in region 56 may tend to block radio-frequency signals. However, radio-frequency signals may pass through the display cover layer (e.g., through a cover glass layer) and may pass through the opaque masking layer in inactive display region (as an example). Radio-frequency signals may also pass through antenna window 58 or dielectric housing walls in housing formed from dielectric material. Lower-frequency electromagnetic fields may also pass through window 58 or other dielectric housing structures, so capacitance measurements for a proximity sensor may be made through antenna window 58 or other dielectric housing structures, if desired.

With one suitable arrangement, housing 12 may be formed from a metal such as aluminum. Portions of housing 12 in the vicinity of antenna window 58 may be used as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved exterior surface along the edge of device 10.

Figure 2:
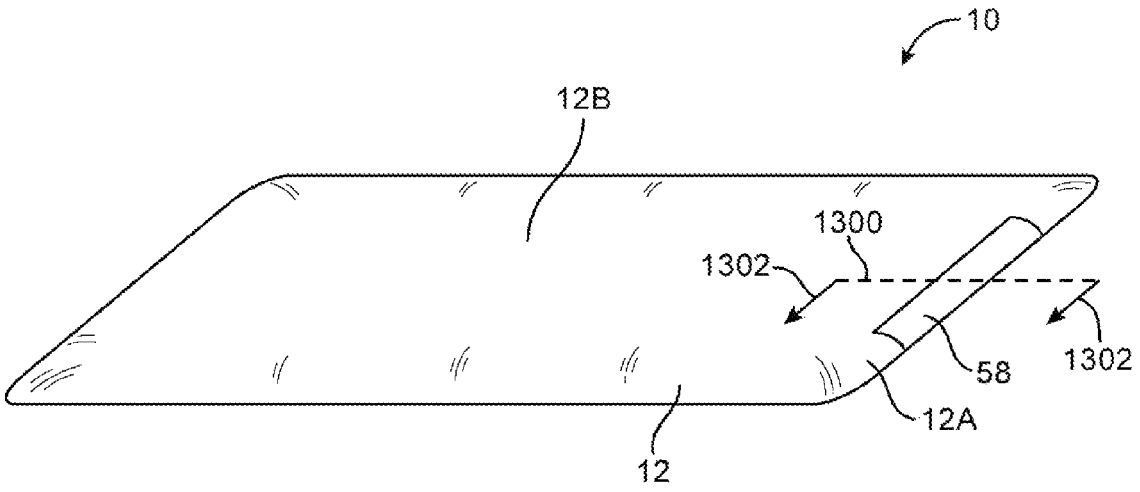
FIG. 2 is a rear perspective view of an illustrative electronic device such as the electronic device of FIG. 1 in accordance with an embodiment of the present invention.

FIG. 2 is a rear perspective view of device 10 of FIG. 1 showing how device 10 may have a relatively planar rear surface 12B and showing how antenna window 58 may be rectangular in shape with curved portions that match the shape of curved housing edges 12A. Antenna window 58 may also have planar walls, if desired.

Figure 3:
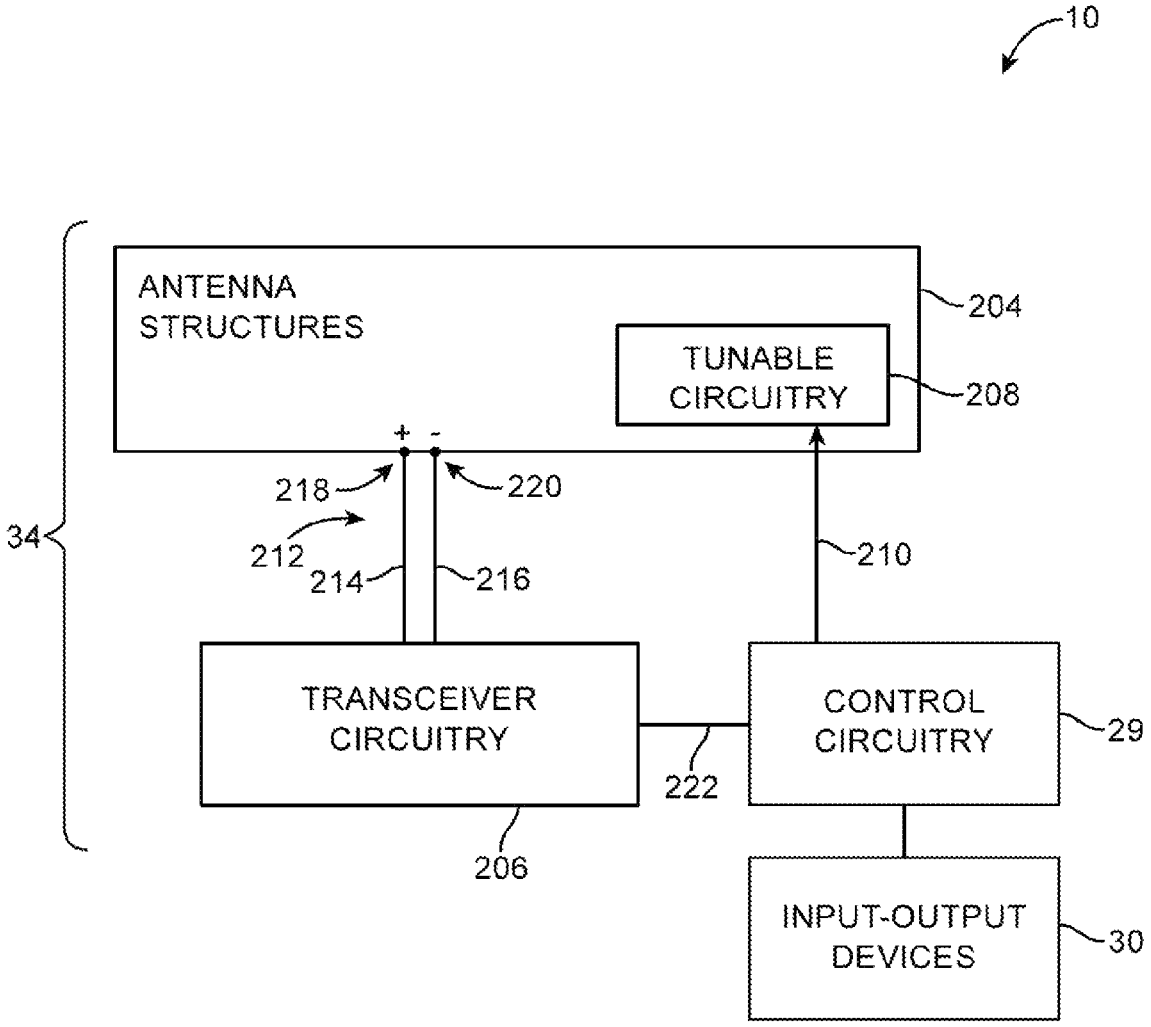
FIG. 3 is a diagram of antenna structures and associated circuitry in an electronic device in accordance with an embodiment of the present invention.

A schematic diagram of an illustrative configuration that may be used for electronic device 10 is shown in FIG. 3. As shown in FIG. 3, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may, for example, transmit and receive wireless data, tune antennas to cover communications bands of interest, and perform other functions related to the operation of device 10.

Input-output devices 30 may be used to allow data to be supplied to device 10 and to allow data to be provided from device 10 to external devices. Input-output circuitry 30 may include communications circuitry such as wired communications circuitry. Device 10 may also use wireless circuitry such as transceiver circuitry 206 and antenna structures 204 to communicate over one or more wireless communications bands.

Input-output devices 30 may also include input-output components with which a user can control the operation of device 10. A user may, for example, supply commands through input-output devices 30 and may receive status information and other output from device 10 using the output resources of input-output devices 30.

Input-output devices 30 may include sensors and status indicators such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10. Audio components in devices 30 may include speakers and tone generators for presenting sound to a user of device 10 and microphones for gathering user audio input. Devices 30 may include one or more displays. Displays may be used to present images for a user such as text, video, and still images. Sensors in devices 30 may include a touch sensor array that is formed as one of the layers in display 14. During operation, user input may be gathered using buttons and other input-output components in devices 30 such as touch pad sensors, buttons, joysticks, click wheels, scrolling wheels, touch sensors such as a touch sensor array in a touch screen display or a touch pad, key pads, keyboards, vibrators, cameras, and other input-output components.

Wireless communications circuitry 34 may include radio-frequency (RF) transceiver circuitry such as transceiver circuitry 206 that is formed from one or more integrated circuits, power amplifier circuitry, low-noise input amplifiers, passive RF components, one or more antennas such as antenna structures 204, and other circuitry for handling RF wireless signals. Wireless signals can also be sent using light (e.g., using infrared communications).

Wireless communications circuitry 34 may include radio-frequency transceiver circuits for handling multiple radio-frequency communications bands. For example, circuitry 34 may include transceiver circuitry 206 for handling cellular telephone communications, wireless local area network signals, and satellite navigation system signals such as signals at 1575 MHz from satellites associated with the Global Positioning System. Transceiver circuitry 206 may handle 2.4 GHz and 5 GHz bands for WiFi® (IEEE 802.11) communications and may handle the 2.4 GHz Bluetooth° communications band. Circuitry 206 may use cellular telephone transceiver circuitry 38 for handling wireless communications in cellular telephone bands such as the bands in the range of 700 MHz to 2.7 GHz (as examples).

Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth° links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antenna structures 204. Antenna structures 204 may include one or more antennas. Antenna structures 204 may include inverted-F antennas, patch antennas, loop antennas, monopoles, dipoles, single-band antennas, dual-band antennas, antennas that cover more than two bands, or other suitable antennas. Configurations in which at least one antenna in device 10 is formed from an inverted-F antenna structure such as a dual band inverted-F antenna are sometimes described herein as an example.

To provide antenna structures 204 with the ability to cover communications frequencies of interest, antenna structures 204 may be provided with tunable circuitry 208. Tunable circuitry 208 may be controlled by control signals from control circuitry 29. For example, control circuitry 29 may supply control signals to tunable circuitry 208 via control path 210 during operation of device 10 whenever it is desired to tune antenna structures 204 to cover a desired communications band. Path 222 may be used to convey data between control circuitry 29 and wireless communications circuitry 34 (e.g., when transmitting wireless data or when receiving and processing wireless data).

Transceiver circuitry 206 may be coupled to antenna structures 204 by signal paths such as signal path 212. Signal path 212 may include one or more transmission lines. As an example, signal path 212 of FIG. 3 may be a transmission line having a positive signal conductor such as line 214 and a ground signal conductor such as line 216. Lines 214 and 216 may form parts of a coaxial cable or a microstrip transmission line having an impedance of 50 ohms (as an example). A matching network formed from components such as inductors, resistors, and capacitors may be used in matching the impedance of antenna structures 204 to the impedance of transmission line 212. Matching network components may be provided as discrete components (e.g., surface mount technology components) or may be formed from housing structures, printed circuit board structures, traces on plastic supports, etc.

Transmission line 212 may be coupled to antenna feed structures associated with antenna structures 204. As an example, antenna structures 204 may form an inverted-F antenna having an antenna feed with a positive antenna feed terminal such as terminal 218 and a ground antenna feed terminal such as ground antenna feed terminal 220. Positive transmission line conductor 214 may be coupled to positive antenna feed terminal 218 and ground transmission line conductor 216 may be coupled to ground antenna feed terminal 220. Other types of antenna feed arrangements may be used if desired. The illustrative feeding configuration of FIG. 3 is merely illustrative.

Tunable circuitry 208 may be formed from one or more tunable circuits such as circuits based on capacitors, resistors, inductors, and switches. Tunable circuitry 208 may be implemented using discrete components mounted to a printed circuit such as a rigid printed circuit board (e.g., a printed circuit board formed from glass-filled epoxy), a flexible printed circuit formed from a sheet of polyimide or a layer of other flexible polymer, a plastic carrier, a glass carrier, a ceramic carrier, or other dielectric substrate. As an example, tunable circuitry 208 may be coupled to a dielectric carrier of the type that may be used in supporting antenna resonating element traces for antenna structures 204 (FIG. 3).

FIGS. 4, 5, 6, 7, 8, 9, and 10 are diagrams of illustrative tunable circuits of the types that may be used in implementing some or all of tunable antenna circuitry 208 of FIG. 3. Tunable antenna circuits 208 may have two or more terminals. For example, tunable antenna components 208 may each have respective first and second terminals 228 and 230. Terminals 228 and 230 may be coupled to conductive structures at different respective locations within antenna structures 204. During operation of device 10, control circuitry 29 may issue commands on path 210 to adjust switches, variable components, and other adjustable circuitry in tunable circuitry 208, thereby tuning antenna structures 204.

As shown FIG. 4, tunable circuitry 208 may include a series-coupled inductor and switch such as inductor 224 and switch 226. Inductor 224 and switch 226 may be connected in series between terminals 228 and 230. Switch 226 may be closed to switch inductor 224 into use and may be opened when it is desired to remove inductor 224 from use in antenna structures 204.

As shown in FIG. 5, tunable circuitry 208 may include a series-coupled capacitor and switch such as capacitor 232 and switch 234. Capacitor 232 and switch 234 may be connected in series between terminals 228 and 230. Switch 234 may be closed to switch capacitor 232 into use and may be opened when it is desired to remove capacitor 232 from use in antenna structures 204.

Tunable components 208 may, if desired, use bypassable components. As shown in FIG. 6, for example, tunable circuit 208 may include an inductor such as inductor 236 that is coupled in parallel with a switch such as switch 238 between terminals 228 and 230. Switch 238 may be closed when it is desired to bypass inductor 236. As shown in FIG. 7, tunable circuit 208 may include a capacitor such as capacitor 240 that is coupled in parallel with a switch such as switch 242 between terminals 228 and 230. Switch 242 may be closed when it is desired to bypass capacitor 240.

Variable components such as varactors, variable inductors, and variable resistors may be used in tunable circuitry 208 to provide continuously adjustable component values. FIG. 8 is a diagram of tunable circuitry 208 in a configuration based on varactors 244. FIG. 9 shows how variable inductor 246 may be used to form tunable circuitry 208. Variable components may, if desired, be coupled in series or parallel with switches.

Switches in tunable circuitry 208 may be based on diodes, transistors, microelectromechanical systems (MEMS) devices, or other switching circuitry.

As shown in FIG. 10, tunable circuitry 208 may include multiple components 248. Components 248 may be coupled in series and/or in parallel between terminals 228 and 230. Each component 248 in FIG. 10 may be implemented using one or more of the circuits of FIGS. 4, 5, 6, 7, 8, and 9, switches, variable components, bypassable components, or other tunable components. As an example, tunable component 208 may be implemented using two or more or three or more series-connected adjustable inductors (e.g., inductors implemented using circuit 208 of FIG. 4, circuit 208 of FIG. 6, or circuit 208 of FIG. 9).

Figure 11:
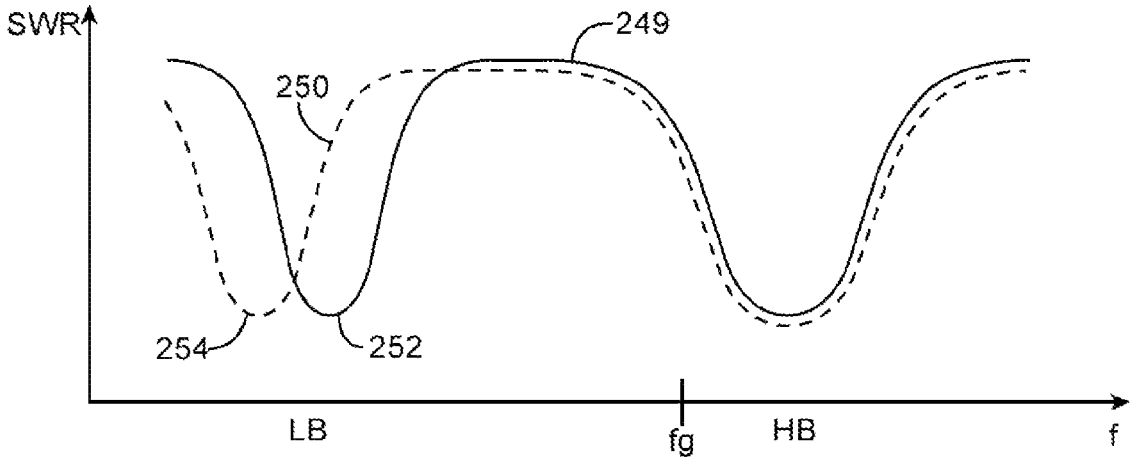
FIG. 11 is a plot of antenna performance (standing-wave ratio) as a function of operating frequency for an illustrative tunable antenna having a tunable low band resonance and a fixed high band resonance in accordance with an embodiment of the present invention.

As shown in FIG. 11, antenna structures 204 may be configured to exhibit multiple resonance peaks. In the graph of FIG. 11, antenna performance (standing-wave ratio) has been plotted as a function of antenna operating frequency f. In the FIG. 11 example, antenna structures 204 have been configured for dual band operation, so antenna performance curve 249 exhibits two resonance peaks—a first resonance peak at lower frequencies (i.e., low band frequency band LB) and a second resonance peak at higher frequencies (i.e., high band frequency band HB). Low band frequencies LB and high band frequencies HB may, as an example, be associated with low band cellular telephone frequencies and high band cellular telephone frequencies and/or frequencies associated with satellite navigation system signals. If desired, low band frequencies LB and high band frequencies HB may be associated with other types of communications (e.g., wireless local area network communications, etc.).

With one suitable arrangement, low band LB may be associated with cellular telephone frequencies such as frequencies between 700 MHz and 960 MHz. High band HB may cover satellite navigation system frequency fg (e.g., a 1575 MHz frequency associated with use of Global Positioning System signals for satellite navigation) and cellular telephone signals up to about 2170 MHz (as an example).

During tuning operations, control circuitry 29 of FIG. 3 may issue commands on control path 210 that adjust tunable circuitry 208. The impact of adjusting tunable circuitry 208 on antenna performance depends on the configuration of tunable circuitry 208 and the conductive antenna structures in antenna structures 204. With one suitable arrangement, tuning adjustments tend to alter low band performance more than high band performance. For example, low band tuning adjustments may leave high band HB unchanged, so that signals such as satellite navigation system signals at frequency fg can be received in high band HB regardless of whether or not tuning adjustments to low band LB are being made.

In the configuration of FIG. 11, dashed line 250 corresponds to the performance of antenna structures 204 following antenna tuning operations. As shown in the example of FIG. 11, the impact of the tuning components may be negligible in the high band (i.e., the upper frequency resonance peak at frequencies associated with high band HB may not change during tuning) and significant in the low band (i.e., the lower frequency resonance peak at frequencies associated with low band LB may shift). The lower frequency resonance peak of FIG. 11 may, for example, move from position 252 (e.g., a frequency band covering 820 to 960 MHz or other suitable frequency band) to position 254 (e.g., a frequency band covering 700 to 780 MHz) as tunable circuitry 208 is adjusted. If desired, antenna structures 204 may exhibit different numbers of resonant peaks (one or more, two or more, three or more, or four or more) and different peaks may be adjustable through adjustment of tuning circuitry 208 (e.g., one of the peaks, two of the peaks, three of the peaks, or four or more of the peaks may be tuned).

Figure 12:
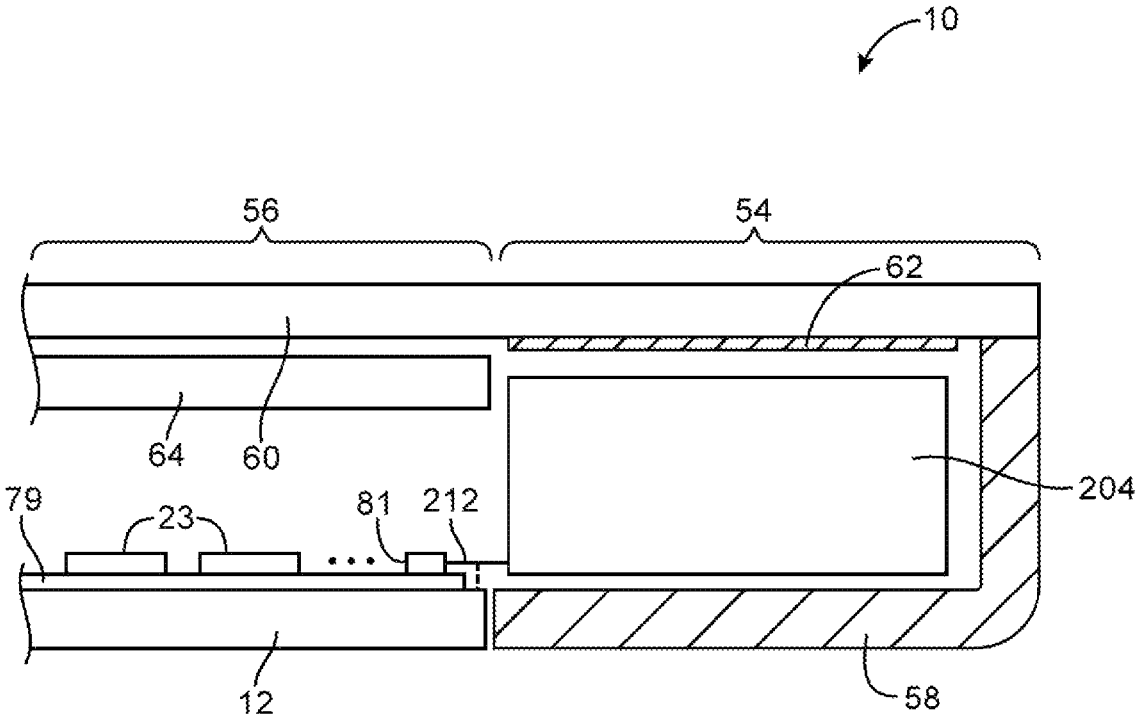
FIG. 12 is a cross-sectional side view of a portion of the electronic device of FIGS. 1 and 2 in accordance with an embodiment of the present invention.

A cross-sectional view of device 10 taken along line 1300 of FIG. 2 and viewed in direction 1302 is shown in FIG. 12. As shown in FIG. 12, antenna structures 204 may be mounted within device 10 in the vicinity of antenna window 58. Structures 204 may include conductive material that serves as an antenna resonating element for an antenna. The antenna may be fed using transmission line 212.

Transmission line 212 may have a positive signal conductor that is coupled to a positive antenna feed terminal such as positive antenna feed terminal 218 of FIG. 3 and a ground signal conductor that is coupled to a ground antenna feed terminal such as ground antenna feed terminal 220 of FIG. 3 (i.e., antenna ground formed from conductive ground traces on a dielectric carrier in antenna structures 204 and/or grounded structures such as grounded portions of housing 12).

The antenna resonating element formed from structures 204 may be based on any suitable antenna resonating element design (e.g., structures 204 may form a patch antenna resonating element, a single arm inverted-F antenna structure, a dual-arm inverted-F antenna structure, other suitable multi-arm or single arm inverted-F antenna structures, a closed and/or open slot antenna structure, a loop antenna structure, a monopole, a dipole, a planar inverted-F antenna structure, a hybrid of any two or more of these designs, etc.). Housing 12 may serve as antenna ground for an antenna formed from structure 204 and/or other conductive structures within device 10 and antenna structures 204 may serve as ground (e.g., conductive components, traces on printed circuits, etc.).

Structures 204 may include patterned conductive structures such as patterned metal structures. The patterned conductive structures may, if desired, be supported by a dielectric carrier. The conductive structures may be formed from a coating, from metal traces on a flexible printed circuit, or from metal traces formed on a plastic carrier using laser-processing techniques or other patterning techniques. Structures 204 may also be formed from stamped metal foil or other metal structures. In configurations for antenna structures 204 that include a dielectric carrier, metal layers may be formed directly on the surface of the dielectric carrier and/or a flexible printed circuit that includes patterned metal traces may be attached to the surface of the dielectric carrier. If desired, conductive material in structures 204 may also form one or more proximity sensor capacitor electrodes.

During operation of the antenna formed from structures 204, radio-frequency antenna signals can be conveyed through dielectric window 58. Radio-frequency antenna signals associated with structures 204 may also be conveyed through a display cover member such as cover layer 60. Display cover layer 60 may be formed from one or more clear layers of glass, plastic, or other materials. Display 50 may have an active region such as region 56 in which cover layer 60 has underlying conductive structure such as display panel module 64. The structures in display panel 64 such as touch sensor electrodes and active display pixel circuitry may be conductive and may therefore attenuate radio-frequency signals. In region 54, however, display 50 may be inactive (i.e., panel 64 may be absent). An opaque masking layer such as plastic or ink 62 may be formed on the underside of transparent cover glass 60 in region 54 to block antenna structures 204 from view by a user of device 10. Opaque material 62 and the dielectric material of cover layer 60 in region 54 may be sufficiently transparent to radio-frequency signals that radio-frequency signals can be conveyed through these structures during operation of device 10.

Device 10 may include one or more internal electrical components such as components 23. Components 23 may include storage and processing circuitry such as microprocessors, digital signal processors, application specific integrated circuits, memory chips, and other control circuitry such as control circuitry 29 of FIG. 3. Components 23 may be mounted on one or more substrates such as substrate 79 (e.g., rigid printed circuit boards such as boards formed from fiberglass-filled epoxy, flexible printed circuits, molded plastic substrates, etc.). Components 23 may include input-output circuitry such as sensor circuitry (e.g., capacitive proximity sensor circuitry), wireless circuitry such as radio-frequency transceiver circuitry 206 of FIG. 3 (e.g., circuitry for cellular telephone communications, wireless local area network communications, satellite navigation system communications, near field communications, and other wireless communications), amplifier circuitry, and other circuits. Connectors such as connector 81 may be used in interconnecting circuitry 23 to communications paths such as transmission line path 212.

Figure 13:
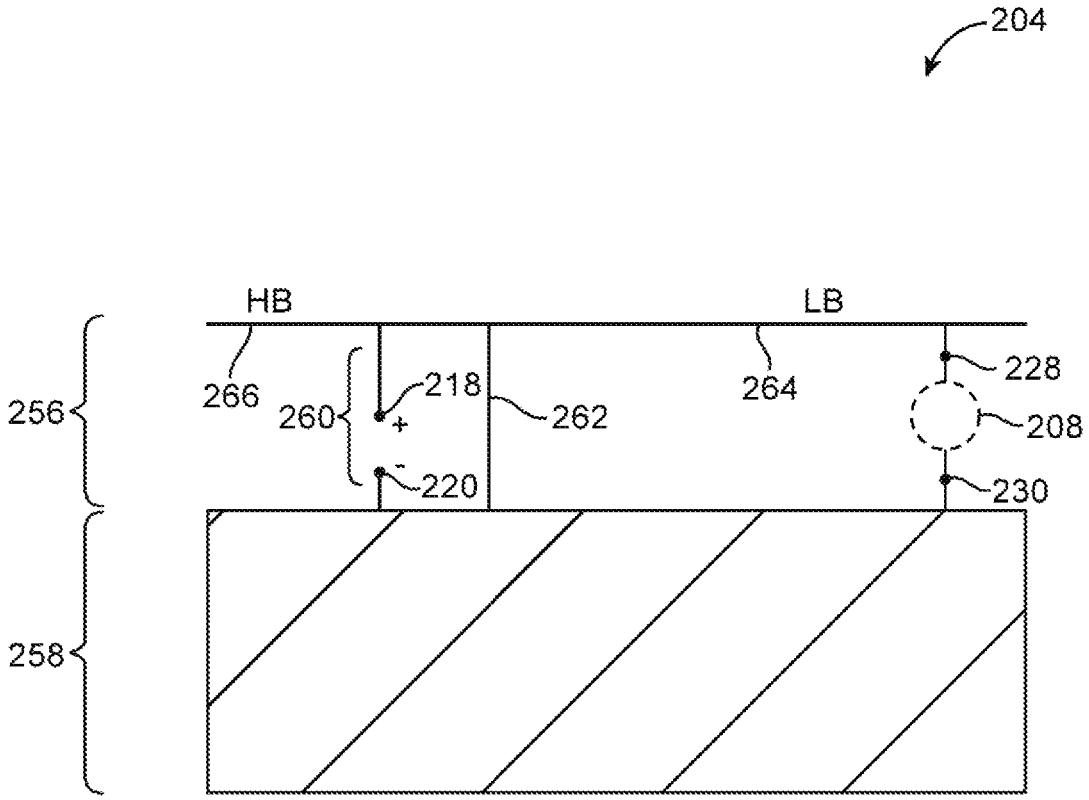
FIG. 13 is a diagram of an illustrative dual arm inverted-F antenna in accordance with an embodiment of the present invention.

FIG. 13 is a diagram of an illustrative dual-band antenna of the type that may be formed using antenna structures 204. As shown in FIG. 13, antenna structures 204 may include antenna resonating element 256 and antenna ground 258. Antenna ground 258 may be formed from conductive portions of antenna structures 204 on a dielectric carrier and/or ground structures such as portions of metal housing 12 that serve as antenna ground. Antenna resonating element 256 may have a resonating element arm structure having a low band arm 264 for resonating in low band LB and high band arm 266 for resonating in high band HB. Short circuit path 262 may couple resonating element arms 264 and 266 to ground 258. Antenna feed 260, which may be formed in parallel with short circuit branch 262, may have a positive antenna feed terminal such as positive antenna feed terminal 218 and a ground antenna feed terminal such as ground antenna feed terminal 220.

During operation, low band arm 264 may give rise to an antenna resonance such as resonance LB in FIG. 11 and high band arm 266 may give rise to an antenna resonance such as resonance HB in FIG. 11. Optional tunable circuitry 208 may be used to tune antenna structures 204 (e.g., to move LB peak 252 to peak position 254. Tunable circuitry 208 may be coupled between any two conductive points on antenna structures 204. The locations of terminals 228 and 230 in FIG. 13 are merely illustrative.

Figure 14:
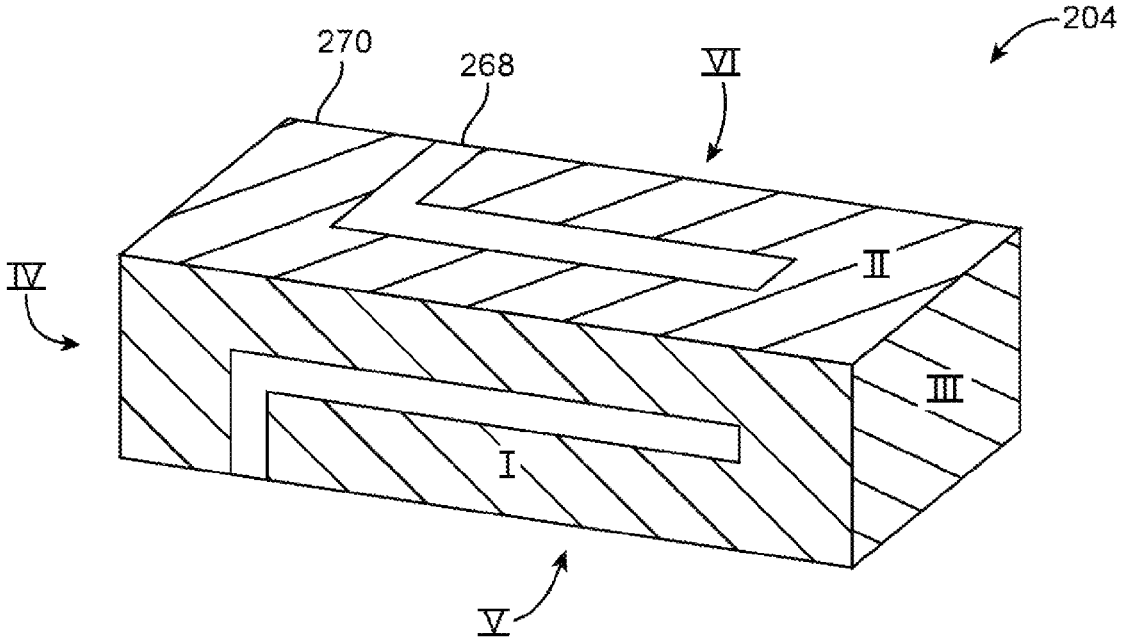
FIG. 14 is a perspective view of an illustrative dual arm inverted-F antenna that has been implemented using traces on a three-dimensional dielectric carrier such as a box-shaped carrier with six sides in accordance with an embodiment of the present invention.

FIG. 14 shows how conductive structures for antenna structures 204 may be supported by a dielectric carrier. As shown in FIG. 14, antenna structures 204 may have conductive structures 270 such as metal structures that are supported by dielectric carrier 268. Conductive structures 270 may be metal traces that are formed on the surface of dielectric carrier 268, may be metal traces on a flexible printed circuit that is mounted on dielectric carrier 268, may be other metal structures supported by carrier 268 (e.g., patterned metal foil), or may be other conductive structures.

Dielectric carrier 268 may be formed from a dielectric material such as glass, ceramic, or plastic. As an example, dielectric carrier 268 may be formed from plastic parts that are molded and/or machined into a desired shape such as the illustrative rectangular prism shape (rectangular box shape) of FIG. 14. If desired, other dielectric carrier shapes (e.g., box or prism shapes with different numbers of sides or other three-dimensional carrier shapes) may be used for antenna structures 204. The example of FIG. 14 is merely illustrative.

As shown in the FIG. 14 configuration, dielectric carrier 268 may have six sides: side I, side II, side III, side IV, side V, and side VI. Metal traces 270 may cover at least some of each of the six sides of carrier 268. Forming antenna structures 204 in this way allows antenna structures 204 to efficiently use a limited volume within device 10 to form an antenna with resonances at desired frequencies. Openings in metal traces 270 (e.g., slot-shaped openings, etc.) may be used to help control the flow of currents in metal traces 270 and thereby adjust antenna performance. If desired, carrier 268 may have other numbers of sides (e.g., four sides, five sides, more than two sides, less than six sides, four or more sides, five or more sides, etc.). The use of six planar sides for carrier 268 is merely illustrative.

Figure 15:
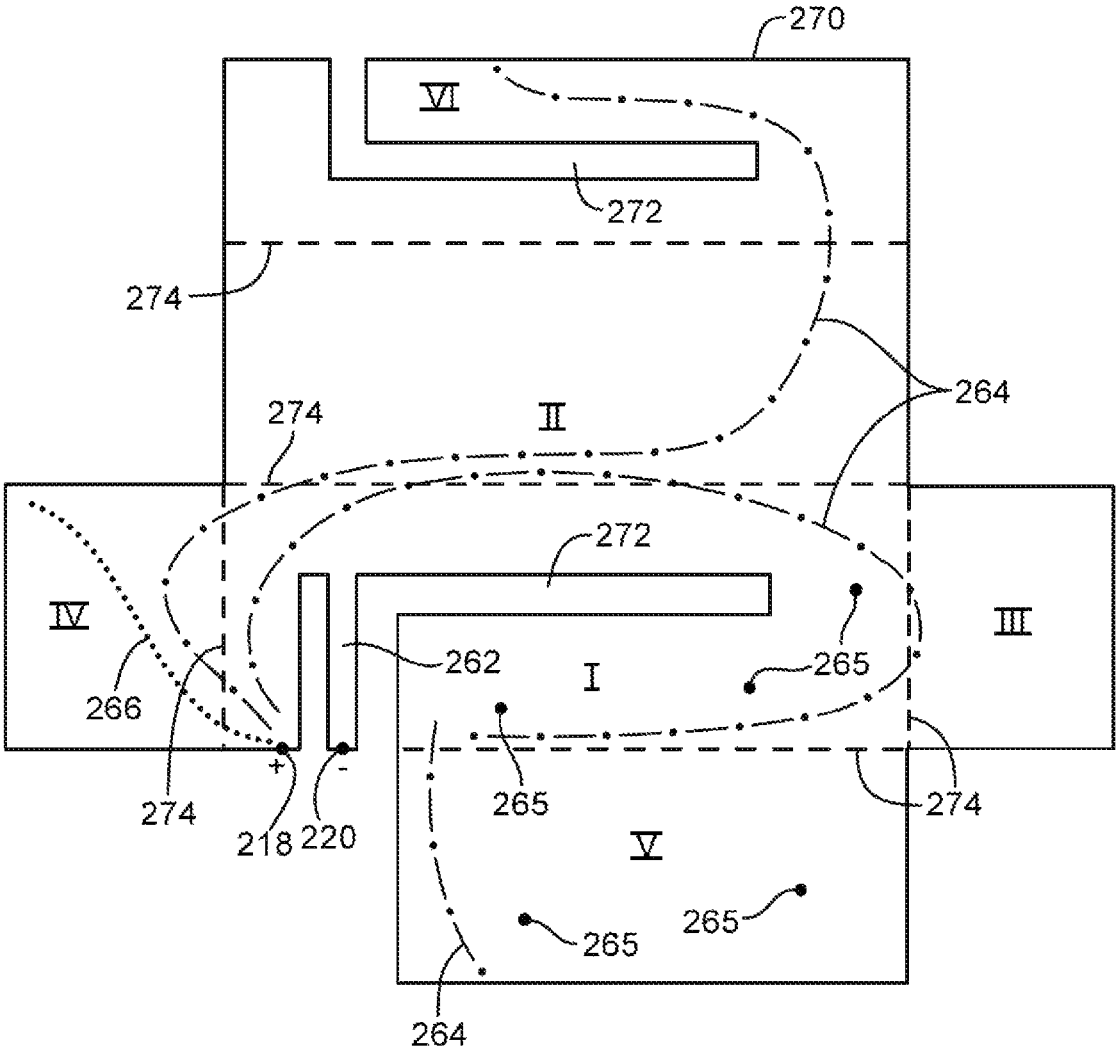
FIG. 15 is a top view of unwrapped metal structures from the illustrative antenna of FIG. 14 in accordance with an embodiment of the present invention.

FIG. 15 is a diagram showing an illustrative pattern that may be used for metal structures 270. In the arrangement of FIG. 15, structures 270 have been unwrapped from carrier 268 and laid out flat. Dashed lines 274 represent fold lines (i.e., axes along which structures 270 are folded when wrapped around carrier 268 to form antenna structures 204 of FIG. 14). Openings such as openings 272 are used to form a desired pattern for conductive structures 270. Metal strip portion 262 of metal structures 270 may serve as short circuit path 262 of FIG. 13. Dotted line path 266 in metal structures 270 shows how portions of metal structures 270 may serve as high band resonating element arm 266 of FIG. 13. Dashed-and-dotted lines 264 in metal structures 270 show how portions of metal structures 270 may also serve as low band resonating element arm 264 of FIG. 13. Transmission line 212 (FIG. 3) may be coupled to antenna feed terminals 218 and 220. Other patterns may be used for metal structures 270 if desired. The configuration of FIG. 15 in which metal structures 270 form a three-dimensional wrapped metal sheet surrounding carrier 268 to implement a dual-band (dual-arm) inverted-F antenna of the type shown in FIG. 13 is merely illustrative.

To provide antenna structures 204 with the ability to be tuned to cover different desired communications bands during use, antenna structures 204 may be provided with tunable circuitry 208. As an example, terminal 228 of tunable circuitry 208 may be coupled to a first location on conductive structures 270 such as one of locations 265 of FIG. 15 and terminal 230 of tunable circuitry 208 may be coupled to a second location on conductive structures 270 such as another one of locations 265 of FIG. 15. In general, locations 265 may be positioned at any points on metal structures 270 that provide a desired amount of antenna response tuning. Locations 265 of FIG. 15 are merely illustrative.

Figure 16:
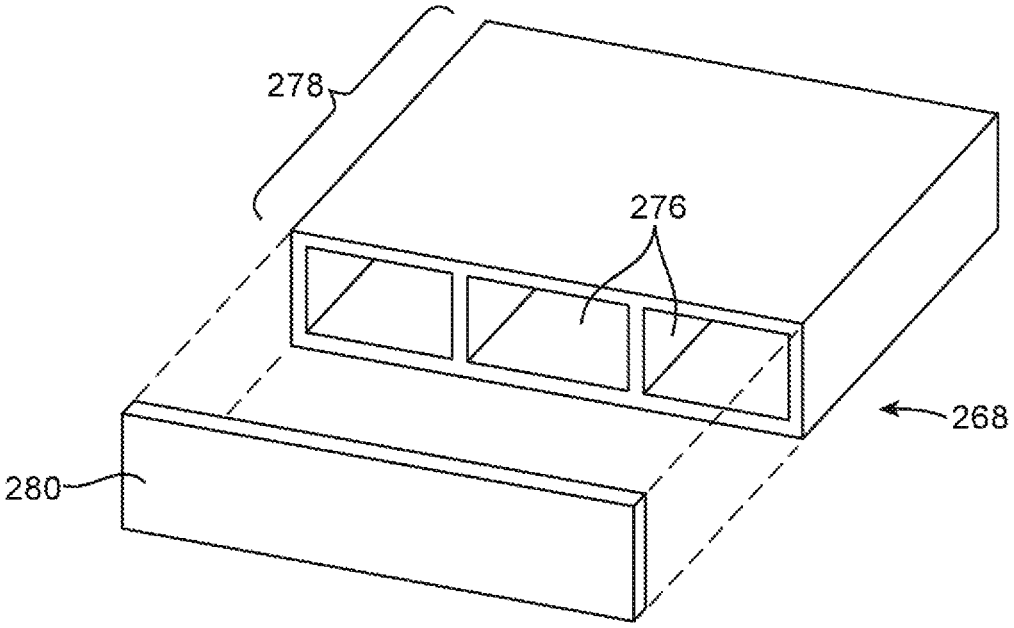
FIG. 16 is a perspective view of a dielectric carrier with air-filled cavities sealed by a lid in accordance with an embodiment of the present invention.

As shown in FIG. 16, dielectric carrier 268 may be formed from a structure that contains one or more cavities (i.e., dielectric carrier 268 may be hollow). In the illustrative configuration shown in FIG. 16, dielectric carrier 268 has three cavities 276. Cavities 276 may, for example, be filled with air, porous material with a low dielectric constant, foam, or other materials. Dielectric carrier 268 may have a body such as portion 278 and a lid portion such as lid 280. Structures 280 and 278 may be attached by adhesive, welds, screws, solder, or other fasteners and attachment mechanisms. As an example, lid 280 may be attached to body 278 using adhesive to seal cavities 276.

Figure 17:
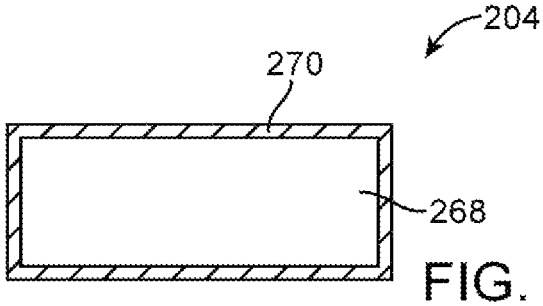
FIG. 17 is a cross-sectional side view of an illustrative antenna having a dielectric carrier coated with metal traces in accordance with an embodiment of the present invention.

Conductive structures 270 may be formed from patterned metal traces formed directly on the surface of dielectric carrier 268, as shown in the cross-sectional side view of FIG. 17.

The pattern of metal used in forming structures 270 may be created by photolithographic patterning, using laser direct structuring (LDS) techniques in which applied laser light (or other activation mechanism) is used to selectively activate desired surface regions on a plastic carrier that are subsequently electroplated or otherwise coated with metal to form patterned metal structures 270, or molded interconnect device (MID) techniques in which multiple shots of plastic (some metal-attracting and some metal-repelling) are used to create desired metal patterns 270 following electroplating or other metal coating operations.

Figure 18:
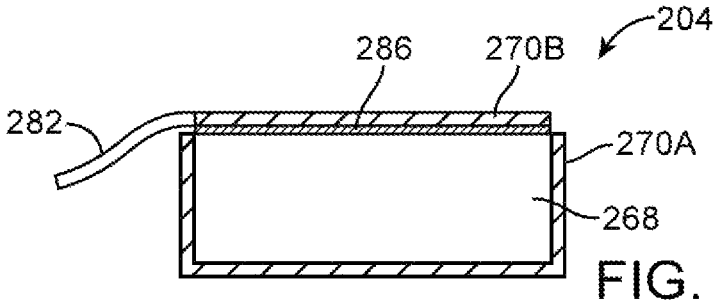
FIG. 18 is a cross-sectional side view of an illustrative antenna having a dielectric carrier partly coated with metal traces and partly covered with traces in a flexible printed circuit in accordance with an embodiment of the present invention.

FIG. 18 shows how a flexible printed circuit such as flexible printed circuit 282 may be provided with metal traces such as metal traces 270B. Adhesive 286, solder, welds, screws, or other fastening arrangements may be used to attach flexible printed circuit 282 to dielectric carrier 268. Metal traces 270A may be formed on the surface of dielectric carrier 268. Metal traces 270A and 270B may form metal structures 270 for antenna structures 204.

Figure 19:
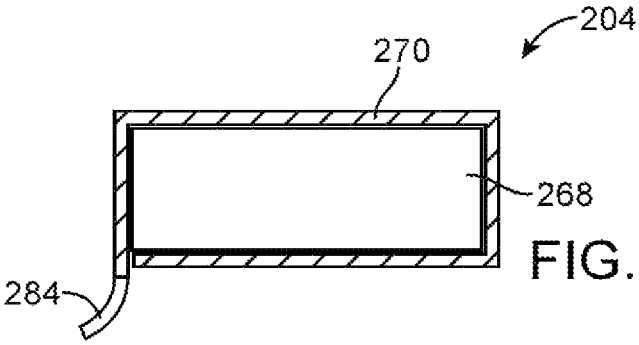
FIG. 19 is a cross-sectional side view of an illustrative antenna having a dielectric carrier wrapped in a flexible printed circuit in accordance with an embodiment of the present invention.

FIG. 19 shows how a flexible printed circuit such as flexible printed circuit 284 may be wrapped around carrier 268 (e.g., on six sides of carrier 268). Traces 270 on flexible printed circuit 284 may be used to form the conductive structures of antenna structures 204.

Figure 20:
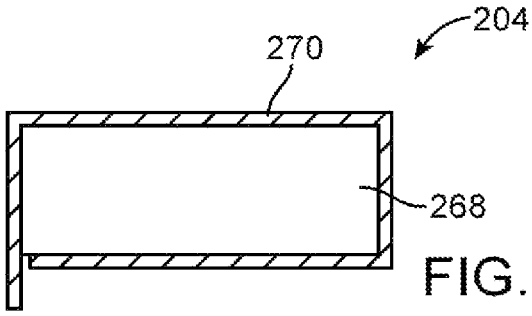
FIG. 20 is a cross-sectional side view of an illustrative antenna having a dielectric carrier partly coated with stamped metal foil structures in accordance with an embodiment of the present invention.

In the illustrative configuration of FIG. 20, antenna structures 204 have been formed from metal foil 270 that has been stamped or otherwise formed into a shape that is wrapped around dielectric carrier 268 (e.g., on six sides of carrier 268). Adhesive, screws, or other attachment mechanisms may be used in attaching foil 270 to carrier 268.

Figure 21:
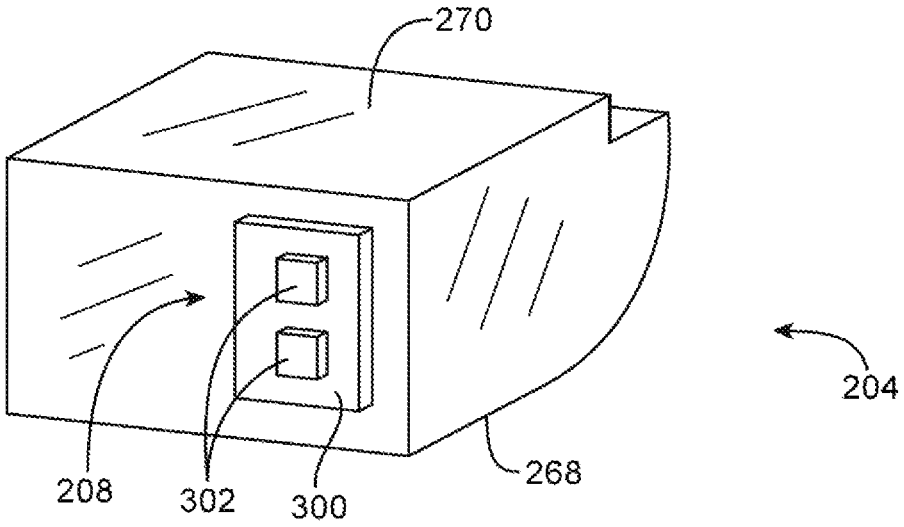
FIG. 21 is a cross-sectional side view of an illustrative antenna having a dielectric carrier with metal structures and a tunable circuit in accordance with an embodiment of the present invention.

FIG. 21 is a perspective view of antenna structures 204 in a configuration in which conductive structures 270 on dielectric carrier 268 have been provided with tunable circuitry 208. Tunable circuitry 208 may be implemented using one or more components such as components 302. Components 302 may be surface mount technology (SMT) components or other circuits for implementing circuitry of the type described in connection with FIGS. 4, 5, 6, 7, 8, 9, and 10. Components 302 may be mounted on a substrate such as flexible printed circuit substrate 300 (e.g., using solder). Substrate 300 may have traces that couple the circuitry of components 302 to locations on structures 270 such as locations 265 of FIG. 15, thereby coupling tunable circuitry 208 into the conductive structures of antenna structures 204. Tunable circuitry 208 may be used to adjust the performance of antenna structures 204 as described in connection with FIG. 11 during operation of electronic device 10.

Figure 22:
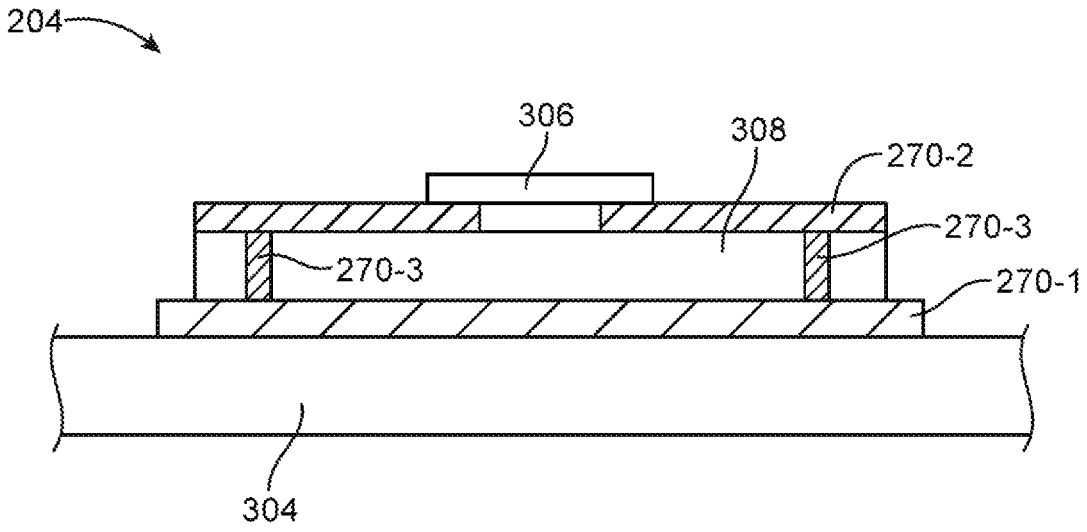
FIG. 22 is a cross-sectional side view of a portion of an illustrative antenna having a dielectric carrier formed from multiple shots of plastic in accordance with an embodiment of the present invention.

FIG. 22 is a cross-sectional side view of a portion of antenna structures 204 in a configuration in which layers of plastic (e.g., multiple shots of injection molded plastic) have been used in forming layers of structures 204. First plastic shot 304 may form the main body of dielectric carrier 268. Metal structures 270-1 may be patterned metal traces that are deposited directly on the surface of plastic structure 304. Second plastic shot 308 may be formed on top of metal layer 270-1. Vias may be formed and filled with metal 270-3. Metal traces 270-2 may then be deposited and patterned on top of second plastic structures 308. Components such as component 306 or other structures may be coupled to metal traces 270-2 (e.g., to implement tunable circuitry 208). Structures 270-1, 270-2, and 270-3 of FIG. 22 may serve as conductive structures 270 of antenna structures 204 (see, e.g., FIG. 15).

The foregoing is merely illustrative of the principles of this invention and various modifications can be made by those skilled in the art without departing from the scope and spirit of the invention.

What is claimed is:

1. An antenna, comprising:

a dielectric carrier having at least five sides;

a conductor on the at least five sides that forms an antenna resonating element, wherein the conductor covers at least the five sides; and positive and ground antenna feed terminals connected to the conductor.

2. The antenna defined in claim 1 wherein the antenna resonating element has a first arm that is configured to exhibit a resonance in a first frequency band and a second arm that is longer than the first arm and that is configured to exhibit a resonance in a second frequency band that is lower than the first frequency band.

3. The antenna defined in claim 2 further comprising tunable circuitry that is configured to tune the antenna.

4. The antenna defined in claim 3 wherein the tunable circuitry is configured to tune the resonance in the second frequency band without tuning the resonance in the first frequency band.

5. The antenna defined in claim 4 wherein the dielectric carrier has six sides and wherein the conductor covers at least part of each of the six sides.

6. The antenna defined in claim 5 wherein the dielectric carrier is hollow.

7. The antenna defined in claim 6 wherein the dielectric carrier has a body with cavities and a lid that is configured to attach to the body.

8. The antenna defined in claim 1 wherein the first and second frequency bands comprise bands selected from the group consisting of: cellular telephone frequency bands and satellite navigation system bands.

9. The antenna defined in claim 1 wherein the antenna resonating element comprises a dual-band inverted-F antenna resonating element.

10. The antenna defined in claim 9 wherein the dielectric carrier comprises a plastic box.

11. The antenna defined in claim 10 wherein the dielectric carrier has six sides.

12. The antenna defined in claim 11 further comprising tuning circuitry having first and second terminals that are both coupled to the conductive traces on one of the six sides.

13. The antenna defined in claim 12 wherein the tuning circuitry comprises a plurality of inductors and switches.

14. The antenna defined in claim 1, wherein the positive and ground antenna feed terminals are directly connected to the conductor at a given one of the at least five sides.

15. The antenna defined in claim 1, wherein the conductor completely covers at least four sides of the dielectric carrier.

16. The antenna defined in claim 1, wherein the conductor comprises a slot at a given side of the dielectric carrier.

17. The antenna defined in claim 16, wherein the conductor comprises an additional slot at the given side of the dielectric carrier.

18. The antenna defined in claim 16, wherein the conductor comprises an additional slot at an additional side of the dielectric carrier.

19. The antenna defined in claim 1, wherein the conductor comprises an electrically continuous conductor that covers at least five of the sides.

20. The antenna defined in claim 1, wherein the antenna is formed within an electronic device having a conductive housing and a dielectric window in the conductive housing, and the antenna is configured to radiate radio-frequency signals through the dielectric window in the conductive housing.

* * * * *